US008776419B2

(12) United States Patent
Obermeit

(10) Patent No.: US 8,776,419 B2
(45) Date of Patent: Jul. 15, 2014

(54) DOUBLE STACK MAGAZINE

(75) Inventor: Tobias Obermeit, Orlando, FL (US)

(73) Assignee: Kel-Tec CNC Industries Incorporated, Cocoa, FL (US)

( * ) Notice: Subject to any disclaimer, the term of this patent is extended or adjusted under 35 U.S.C. 154(b) by 12 days.

(21) Appl. No.: 13/428,143

(22) Filed: Mar. 23, 2012

(65) Prior Publication Data

US 2013/0247437 A1 Sep. 26, 2013

(51) Int. Cl.
*F41A 9/61* (2006.01)

(52) U.S. Cl.
USPC ..... 42/49.01

(58) Field of Classification Search
USPC ..... 42/18, 22, 49.01, 49.02, 50; 89/195, 89/197
See application file for complete search history.

(56) References Cited

U.S. PATENT DOCUMENTS 2,296,729 A * 9/1942 Mossberg ..... 42/50
3,226,869 A * 1/1966 Musgrave ..... 42/50
4,589,218 A * 5/1986 Teppa ..... 42/50
2010/0126053 A1* 5/2010 Fitzpatrick et al. ..... 42/50
2010/0269389 A1* 10/2010 Lopez Laparra ..... 42/49.01
2011/0173857 A1* 7/2011 Hogan, Jr. ..... 42/50
2012/0131831 A1* 5/2012 Sullivan et al. ..... 42/50

* cited by examiner

*Primary Examiner* — Gabriel Klein
(74) *Attorney, Agent, or Firm* — Bennett K. Langlotz; Langlotz Patent & Trademark Works

(57) ABSTRACT

Double stack magazines have a tubular body defining an elongated passage and a lower and upper end, a floor plate element connected to the lower end, an elongated separator element within the passage, a follower defining an aperture receiving the separator element and movable within the elongated passage, a spring within the passage having a first end contacting the floor plate, and having an opposed second end contacting and biasing the follower toward the upper end of the body. The separator may be a rod spaced apart from the body surfaces. The spring may be spaced apart from the separator element. The spring may be a coil spring having multiple winds, each encompassing the separator element. The separator element may be medially located in the body. The separator element may be positioned to define first and second stack passages between the left and right side walls and the separator element.

19 Claims, 16 Drawing Sheets

DOUBLE STACK MAGAZINE

FIELD OF THE INVENTION

The present invention relates to firearms, and more particularly to a double stack magazine for rimmed cartridges.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). There also two distinct styles of feed lips. In a single feed design, the top cartridge touches both lips and is commonly used in single column box magazines. A dual or alternating feed magazine consists of a wider set of lips so that the second cartridge in line forces the top cartridge against one lip. This design is easier to load than a single feed design and has proven more resistant to malfunctions in use with dual column magazines.

A box (or "stick") magazine, the most popular type of magazine in modern rifles and handguns, stores cartridges in a straight or gently curved column, either one above the other or staggered zigzag fashion. This zigzag stack is often identified by the misnomer "double stack" when it is actually a single, staggered column. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition. This type of magazine may be straight or curved, the curve being necessary if the rifle uses rimmed ammunition or ammunition with a tapered case.

Conventional double stack magazines have two columns of ammunition stacked together in a staggered manner akin to a zipper. As the rounds are fed into the firearm, the remaining cartridges are pushed into the top magazine taper, which acts as a funnel to feed into the firearm, in the manner of two lanes of traffic merging in polite, alternating fashion. Double-stack magazines have somewhat less than double the capacity of a magazine of similar length for the same caliber at the expense of slightly less reliability because of the chance of a malfunction occurring at the taper to single-column feed.

Single stack magazines are inherently more reliable because they require less pressure to feed and apply limited friction on the rounds being fed into the pistol. They are also less prone to suffering from misalignment of the ammunition if a loaded magazine is dropped on the ground. Double stack magazines are more prone to having the ammunition lose alignment if dropped and will not feed until the cartridges are realigned. Double stack magazines are also vulnerable to slow feeding speeds and malfunctions if any dust or debris is present where the rounds are fed into the top taper of the magazine. Finally, additional pressure from the magazine spring is required to push the cartridges up through the magazine taper, so weak springs will cause malfunctions.

Therefore, a need exists for a new and improved double stack magazine that completely fills a magazine with two discrete columns of cartridges. In this regard, the various embodiments of the present invention substantially fulfill at least some of these needs. In this respect, the double stack magazine according to the present invention substantially departs from the conventional concepts and designs of the prior art, and in doing so provides an apparatus primarily developed for the purpose of providing the additional capacity of a conventional double stack magazine while preventing the cartridges from jamming.

SUMMARY OF THE INVENTION

The present invention provides an improved double stack magazine, and overcomes the above-mentioned disadvantages and drawbacks of the prior art. As such, the general purpose of the present invention, which will be described subsequently in greater detail, is to provide an improved double stack magazine that has all the advantages of the prior art mentioned above.

To attain this, the preferred embodiment of the present invention essentially comprises a tubular body defining an elongated passage and a lower and upper end, a floor plate element connected to the lower end, an elongated separator element within the passage, a follower defining an aperture receiving the separator element and movable within the elongated passage, a spring within the passage having a first end contacting the floor plate, and having an opposed second end contacting and biasing the follower toward the upper end of the body. The separator may be a rod spaced apart from the body surfaces. The spring may be spaced apart from the separator element. The spring may be a coil spring having multiple winds, each encompassing the separator element. The separator element may be medially located in the body. The separator element may be positioned to define first and second stack passages between the left and right side walls and the separator element. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
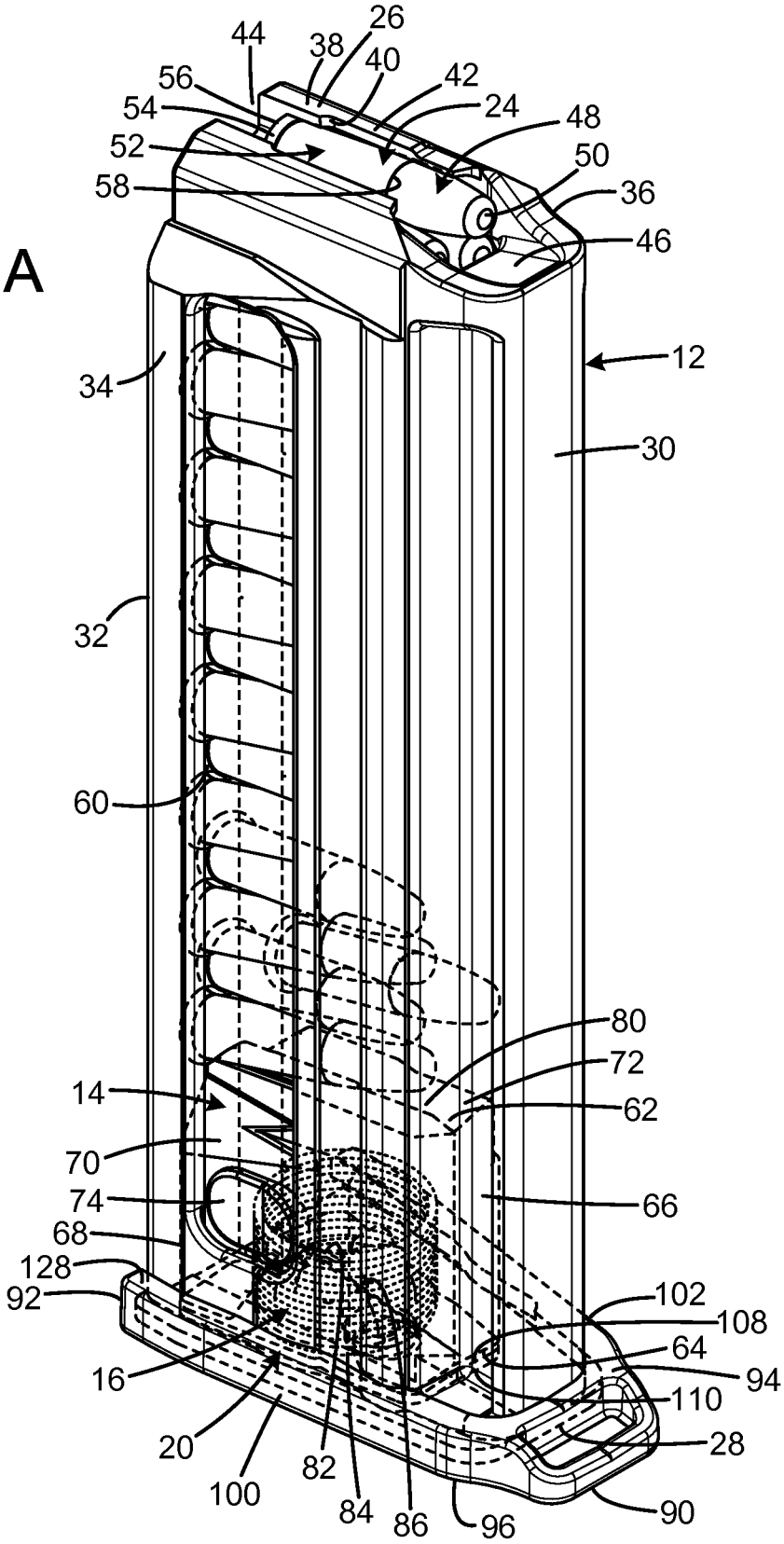
FIG. 1A is a top isometric view of the current embodiment of the double stack magazine constructed in accordance with the principles of the present invention.

An embodiment of the double stack magazine of the present invention is shown and generally designated by the reference numeral 10.

Figure 1B:
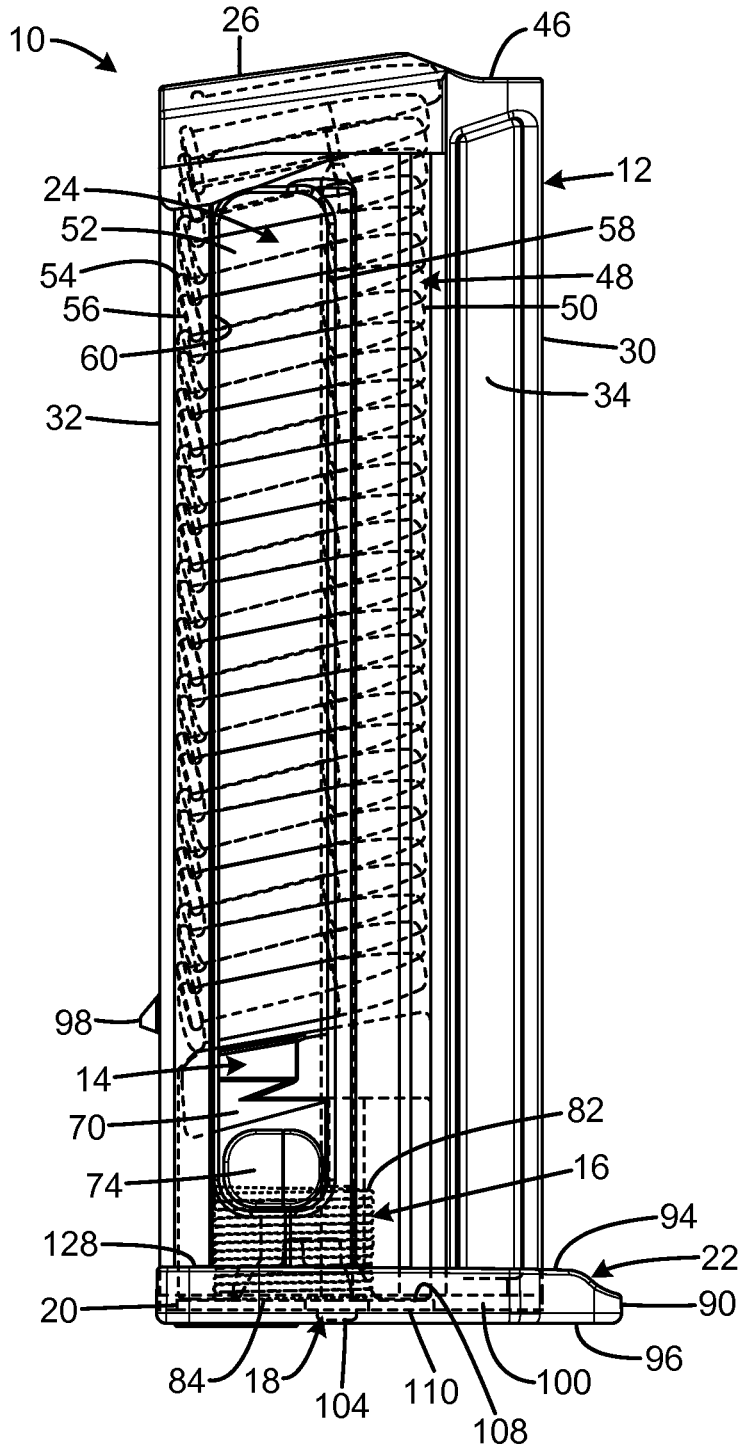
FIG. 1B is a right side view of the current embodiment of the double stack magazine constructed in accordance with the principles of the present invention.
Figure 1C:
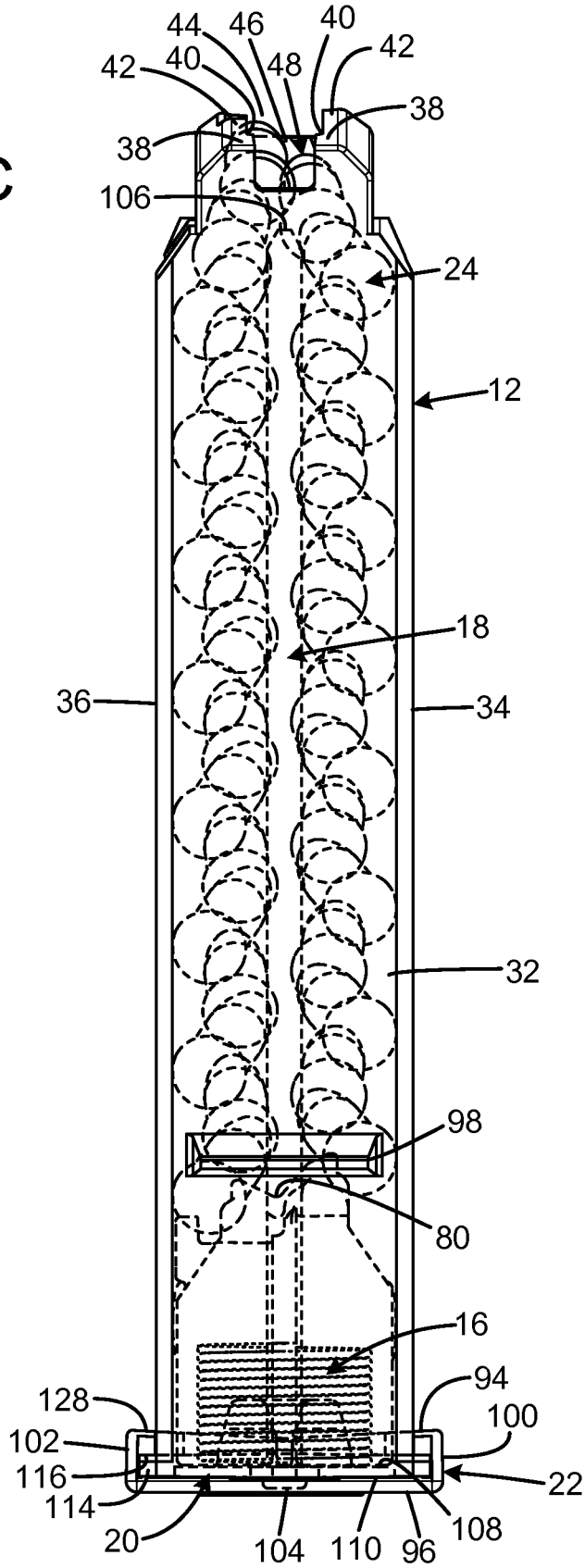
FIG. 1C is a rear isometric view of the current embodiment of the double stack magazine constructed in accordance with the principles of the present invention.

FIGS. 1A-1C illustrate the improved double stack magazine 10 of the present invention. More particularly, the double stack magazine 10 is depicted in a fully loaded condition with the body 12 containing thirty-three cartridges 24. In the current embodiment, the cartridges 24 are .22 Long Rifle rimfire cartridges. The rear 56 of each cartridge forms a rim 54. The front 50 of a bullet 48 protrudes from the front 58 of each of the casings 52. The cartridges are held apart in two discrete stacks by a separating rod 18 and a medial rib 124 (shown in FIGS. 6 and 7B) in the rear 32 of the body. The rib and separating rod define two stack passages, each of which receives one of the two discrete stacks of cartridges. Each cartridge is positioned forward of the cartridge below to prevent rim lock. The cartridges are held at an upwardly sloped angle with their rears lower than their fronts.

The body 12 is generally tubular, and has a front 30, rear 32, right side 70, left side 72, top 26, and bottom 28. The left and right sides of the body each define an elongated vertical slot 60. The top of the body tapers to define an opening 44 bounded by rear lips 38, radiused portions 40, and front lips 42.

The bottom 28 of the body 12 is open to receive a follower 14, a circular coil spring 16, a separating rod 18, and a spring plate 20. The front and sides of the bottom of the body form an outwardly protruding flange 114. A bottom plate 22 defines a slot 116 that receives the flange. The bottom plate closes the bottom end of the body and secures the follower, spring, separating rod, and spring plate within the body.

The rear 32 of the body 12 forms a rearward protruding horizontal ledge 98. The horizontal ledge interacts with a latch (not shown) to removably secure the double stack magazine 10 within a firearm. However, in alternative embodiments, the protruding horizontal ledge may be located on the front 30 of the body or on either side 70, 72 of the body. In the current embodiment, the firearm is a pistol chambered for .22 Long Rifle rimfire cartridges.

Figure 2:
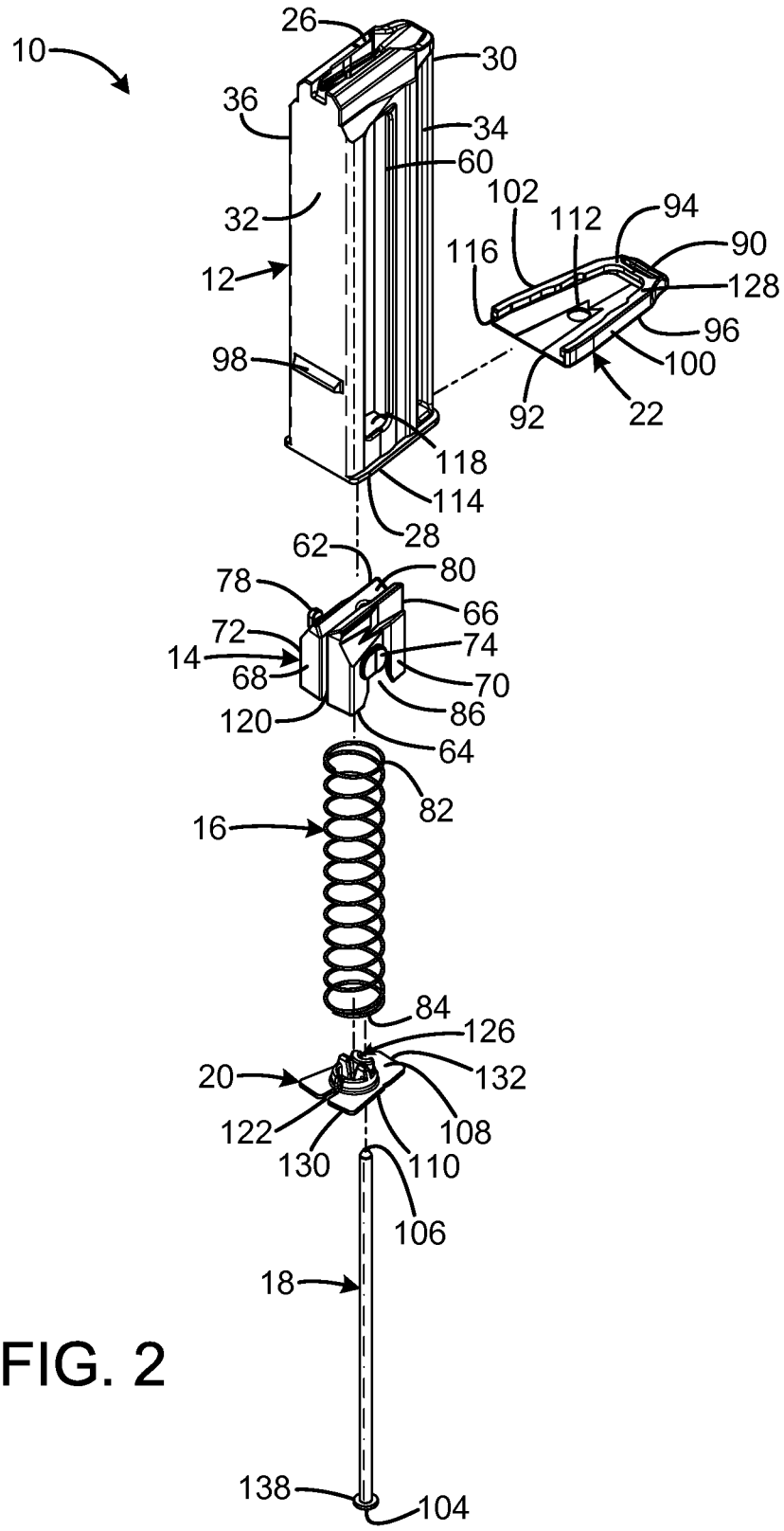
FIG. 2 is a rear isometric exploded view of the current embodiment of the double stack magazine constructed in accordance with the principles of the present invention.

FIG. 2 illustrates the improved double stack magazine 10 of the present invention. More particularly, the double stack magazine is assembled by stacking the spring plate 20, coil spring 16, and follower 14 on the separating rod 18. Then, the upper free end 106 of the separating rod and the top 62 of the follower 14 are inserted up through the open bottom 28 of the body 12. Pads 74 and 76 on the left side 72 and right side 70 of the follower are exposed through the vertical elongate slots 60 on the left side 36 and right side 34 of the body. Subsequently, the spring, spring plate, and the bottom 104 of the separating rod are inserted into the body. Then, the rear 92 of the bottom plate 22 is slid over the flange 114 on the body. The left side 102, right side 100, and front 90 form a top lip 128 at the top 94 of the bottom plate. The top lip defines a slot 116 that receives the flange on the body. Finally, the aperture 112 in the bottom plate receives the bottom 104 of the separating rod to releasably secure the bottom plate to the bottom of the body. Pressure exerted by the spring urges the bottom of the separating rod into the aperture in the bottom plate to prevent lateral movement of the bottom plate while the top lip and flange on the bottom of the body prevent axial movement.

Figure 3A:
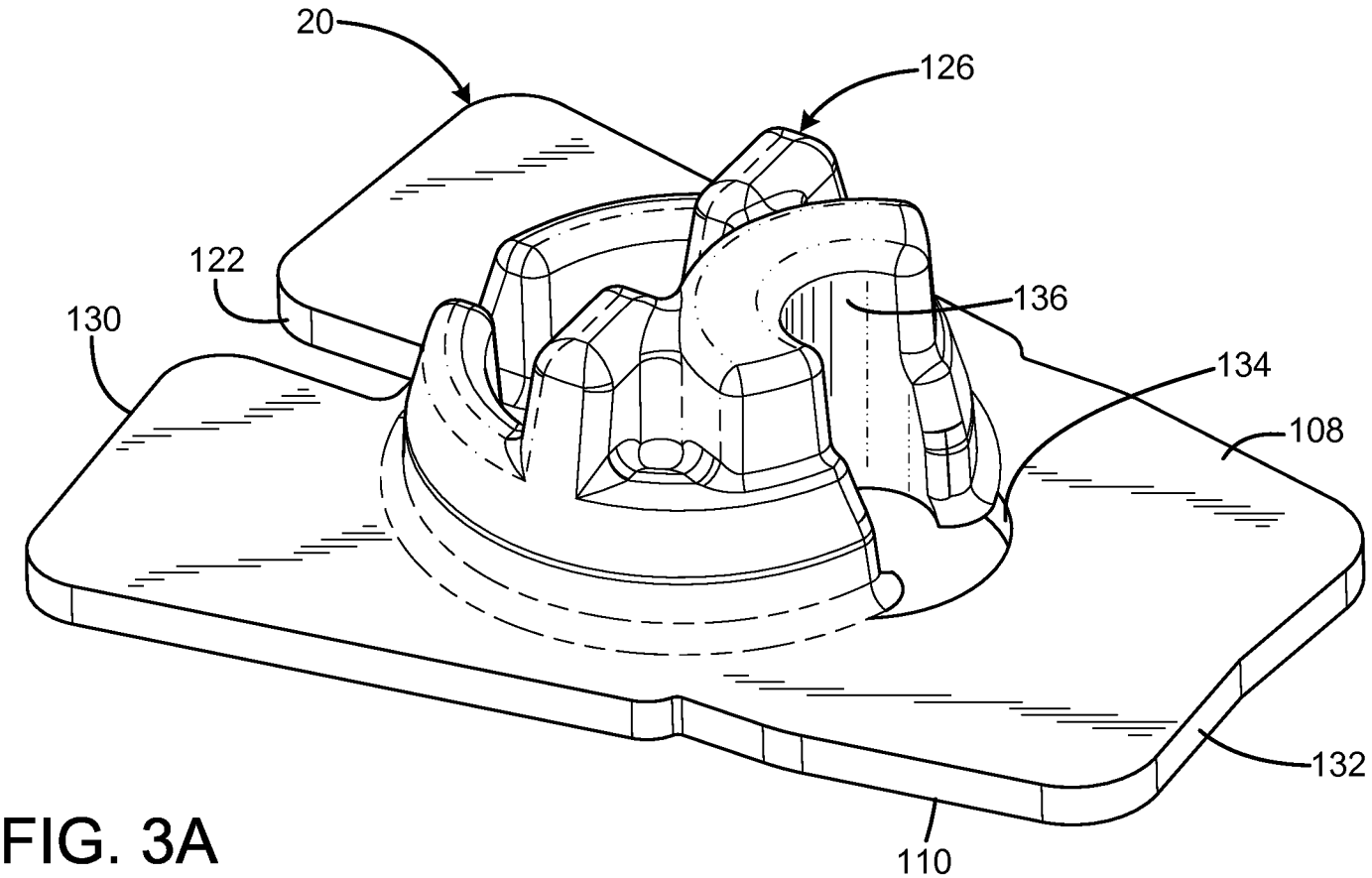
FIG. 3A is a top isometric view of the current embodiment of the spring plate of the present invention removed from the double stack magazine of FIG. 1A.
Figure 3B:
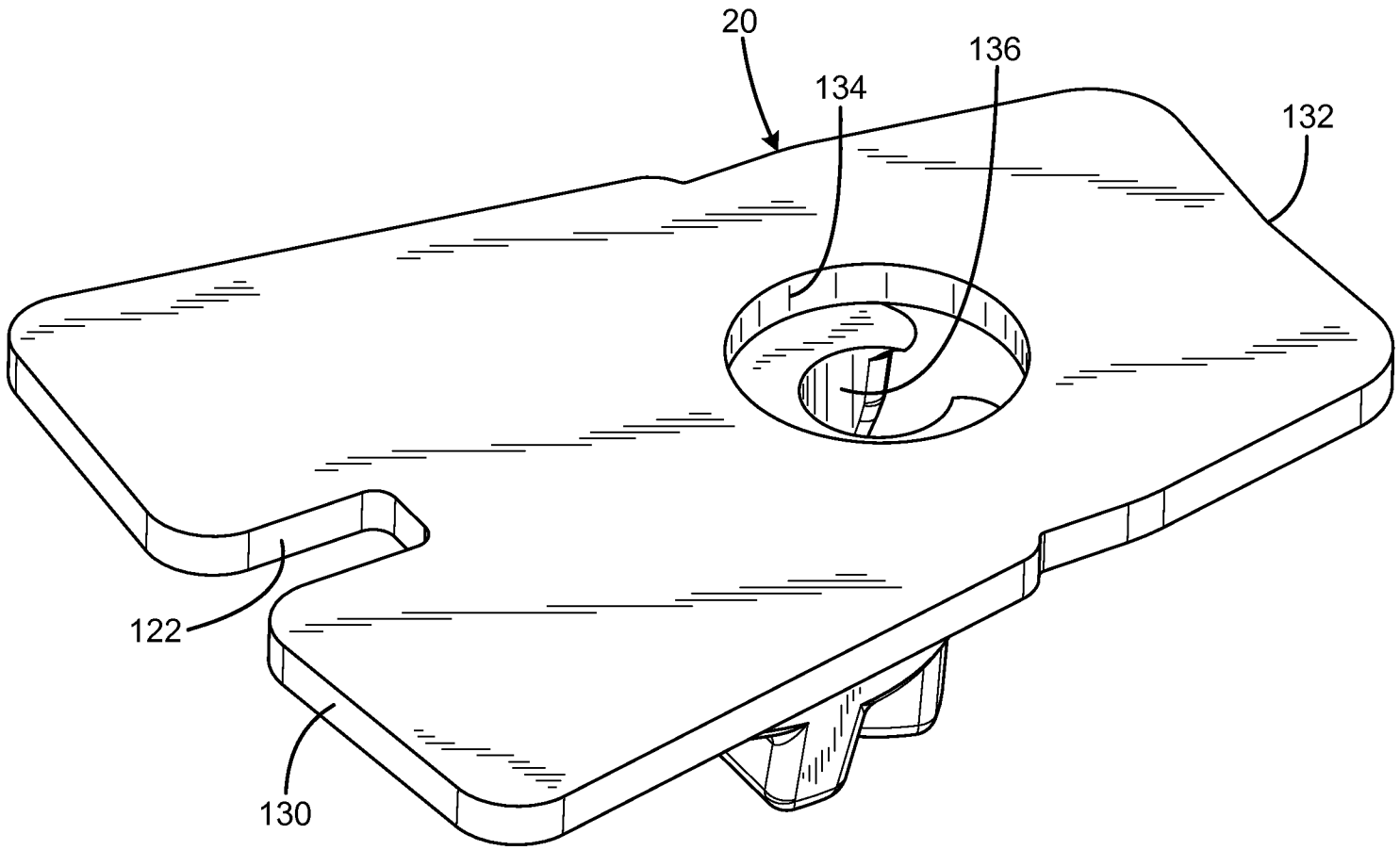
FIG. 3B is a bottom isometric view of the current embodiment of the spring plate of the present invention removed from the double stack magazine of FIG. 1A.

FIGS. 3A and 3B illustrate the improved spring plate 20 of the present invention. More particularly, the spring plate 20 has a front 132, a rear 130, a top 108, and a bottom 110. The width of the spring plate tapers from the rear to the front, in a trapezoidal shape, as the main tube of the magazine. The spring plate defines a central aperture 134 and a slot 122 in the rear. An upward protrusion 126 extends from the top in front of the slot and substantially overlaps the aperture. A bore 136 in the upward protrusion creates a semicircular sleeve that communicates with the aperture. In the current embodiment, the spring plate is made of injection molded plastic.

Figure 4A:
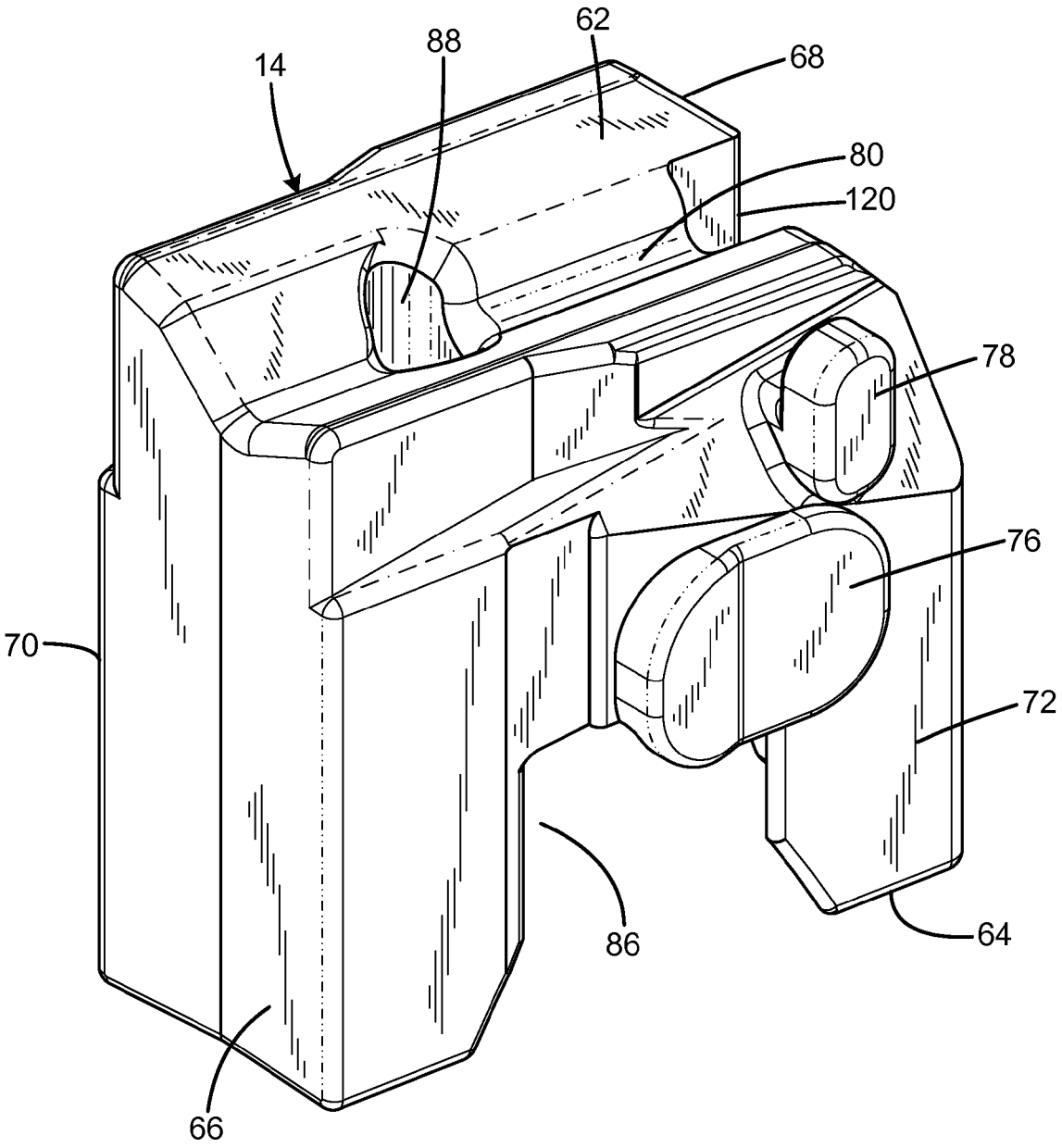
FIG. 4A is a top isometric view of the current embodiment of the follower of the present invention removed from the double stack magazine of FIG. 1A.
Figure 4B:
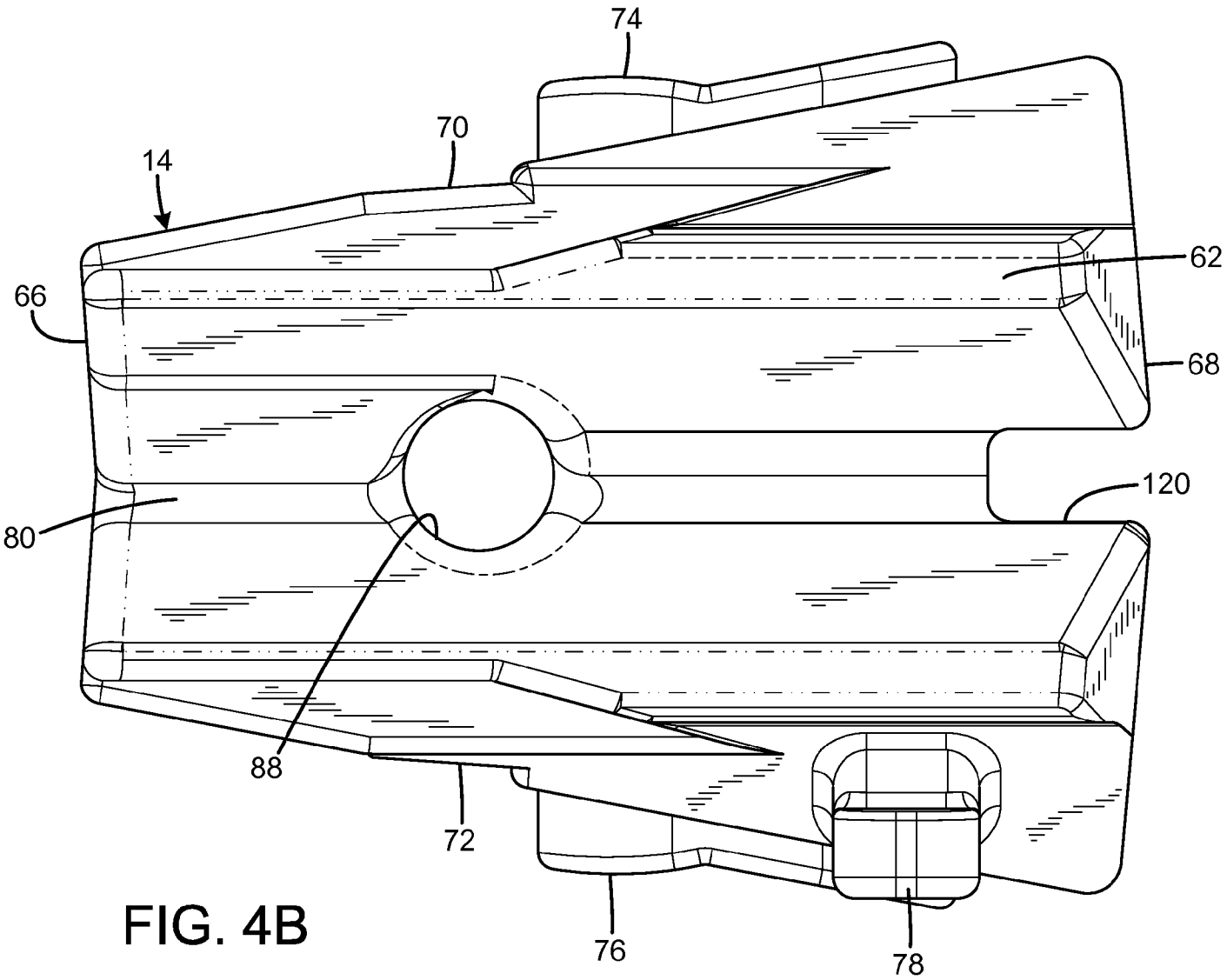
FIG. 4B is a top view of the current embodiment of the follower of the present invention removed from the double stack magazine of FIG. 1A.
Figure 4C:
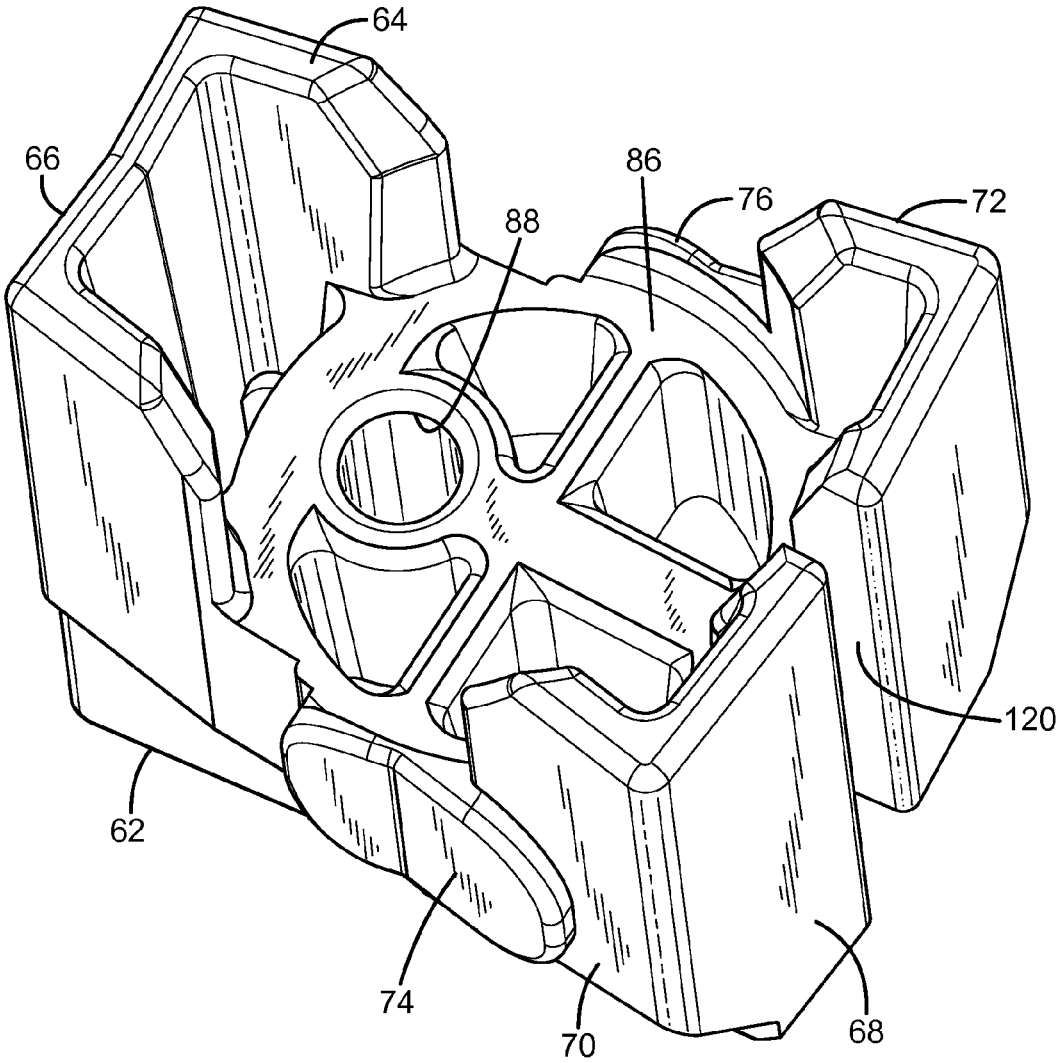
FIG. 4C is a bottom isometric view of the current embodiment of the follower of the present invention removed from the double stack magazine of FIG. 1A.

FIGS. 4A-4C illustrate the improved follower 14 of the present invention. More particularly, the follower has a top 62, bottom 64, left 72, right 70, front 66, and rear 68. The bottom defines an enlarged cavity 86 that communicates with a bore 88 through the top of the follower. The top of the follower defines a V shaped valley 80. The offset V shapes on either side of the valley are what actually contact and position the rounds. The V shapes have an upward slope and are shaped to contact the cartridges in a manner akin to another cartridge. The pads 74, 76 on the right and left sides of the follower enable the follower to be gripped to aid in loading of the double stack magazine 10. The rear of the follower defines an elongated slot 120. The left rear side of the follower forms an upward protrusion 78. In the current embodiment, the follower is made of injection molded plastic.

Figure 5A:
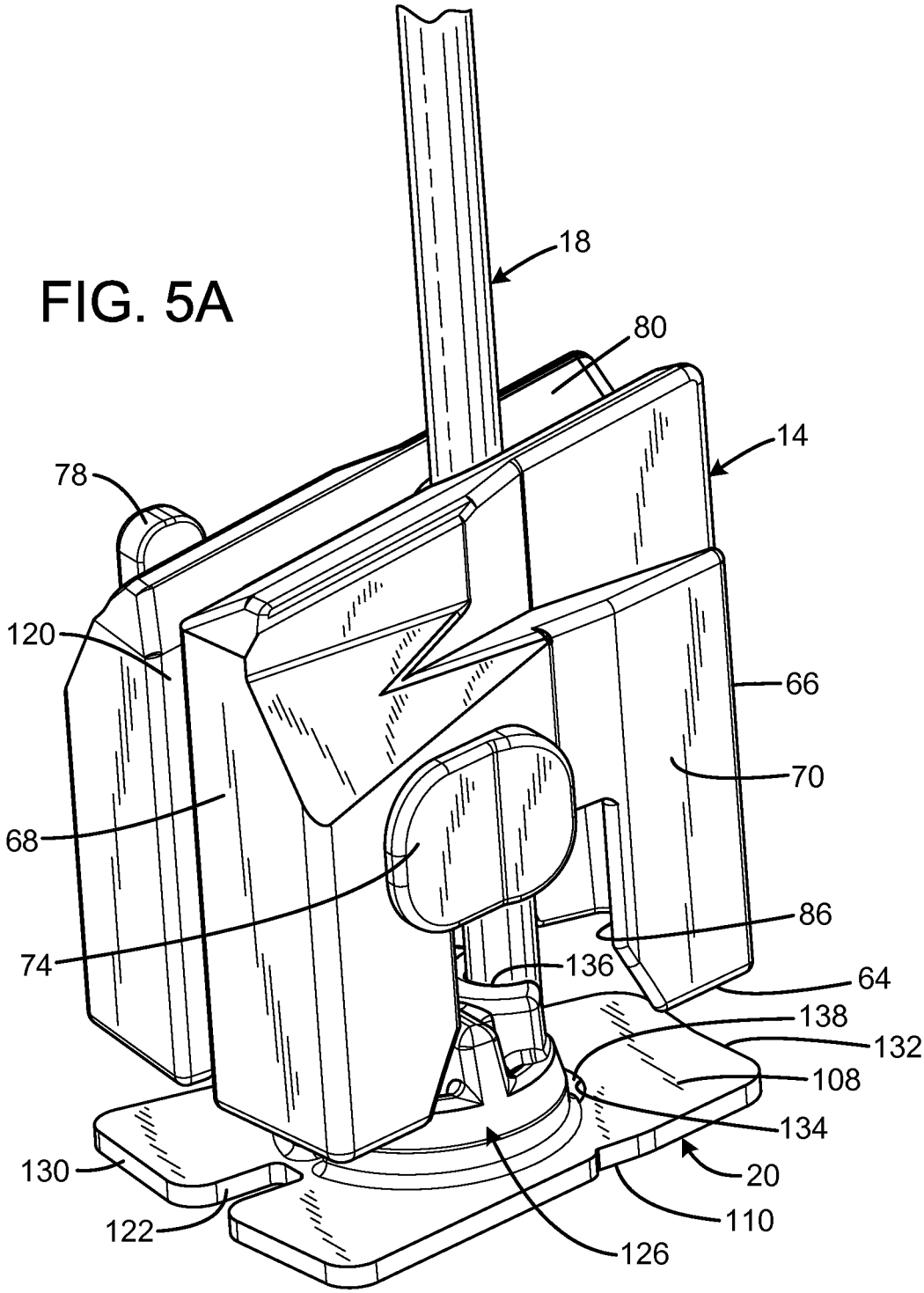
FIG. 5A is a top isometric view of the current embodiment of the spring plate, follower, and separating rod of the present invention removed from the double stack magazine of FIG. 1A.
Figure 5B:
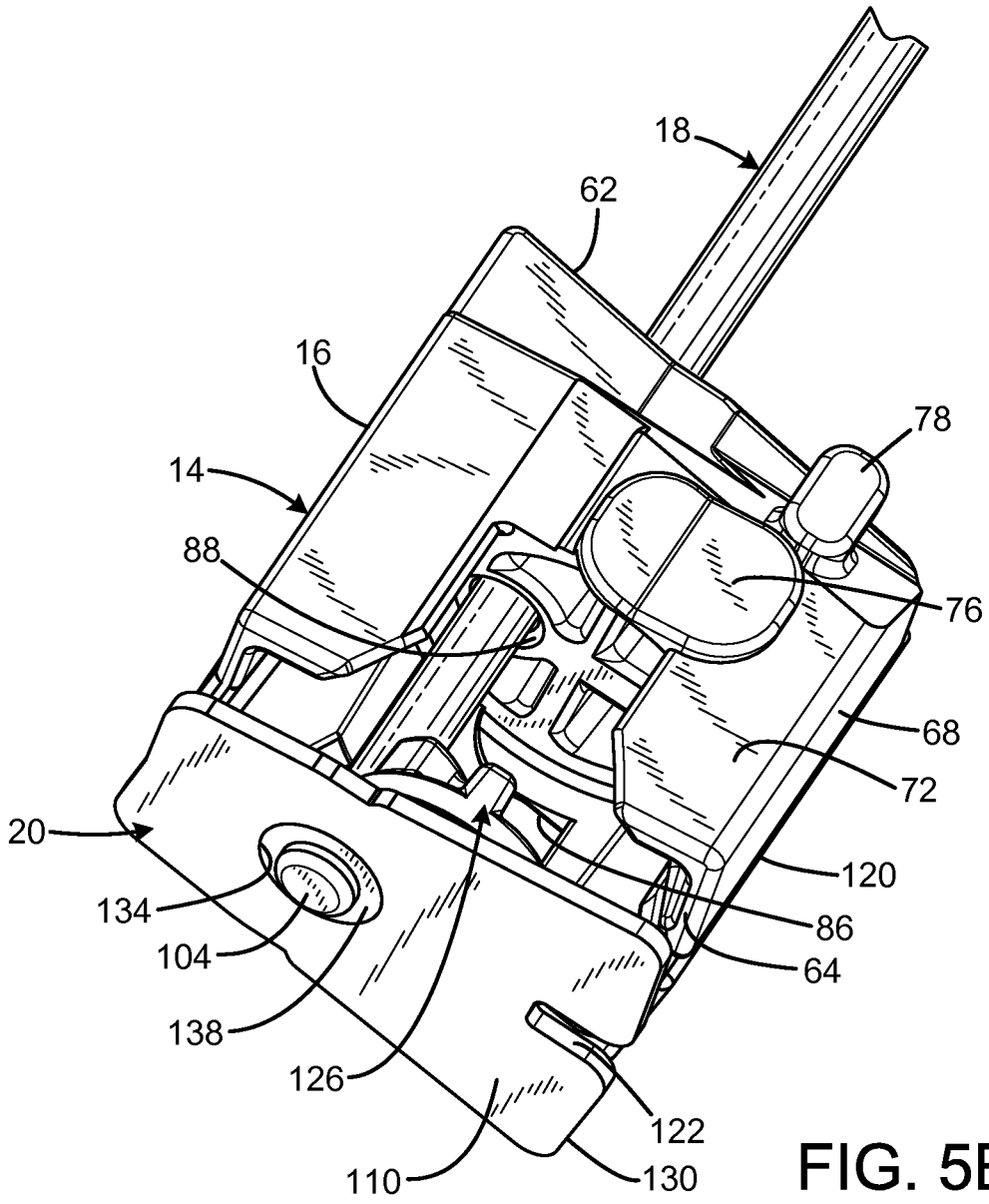
FIG. 5B is a bottom isometric view of the current embodiment of the spring plate, follower, and separating rod of the present invention removed from the double stack magazine of FIG. 1A.

FIGS. 5A and 5B illustrate the improved follower 14, separating rod 18, and spring plate 20 of the present invention. More particularly, the follower, separating rod, and spring plate are shown assembled together without the spring 16, which would be fully compressed if illustrated. The aperture 134 in the spring plate receives the flange 138 on the bottom 104 of the separating rod. The upward protrusion 126 on the top 108 of the spring plate limits upward movement of the flange 138. The bore 136 in the upward protrusion receives and positions the separating rod 18 medially between the right and left side walls 70, 72. Although in the current embodiment the spring plate and separating rod are depicted as discrete parts, the spring plate and separating rod could also the combined into a single injection molded part.

The bore 88 in the follower 14 also receives and positions the separating rod 18. The follower acts as a sliding support bushing for the separating rod as the follower moves up and down as the double stack magazine 10 is unloaded and loaded. The separating rod serves also to prevent canting of the follower. The bore 88 is sized to permit the follower to slide easily on the separating rod.

The upward protrusion 126 on the spring plate 20 does not interact with the follower 14 at all. It only helps hold the separating rod 18 in place and axially registers the bottom 84 of the spring 16. The cavity 86 in the bottom 64 of the follower captures the top 82 of the spring.

Figure 6A:
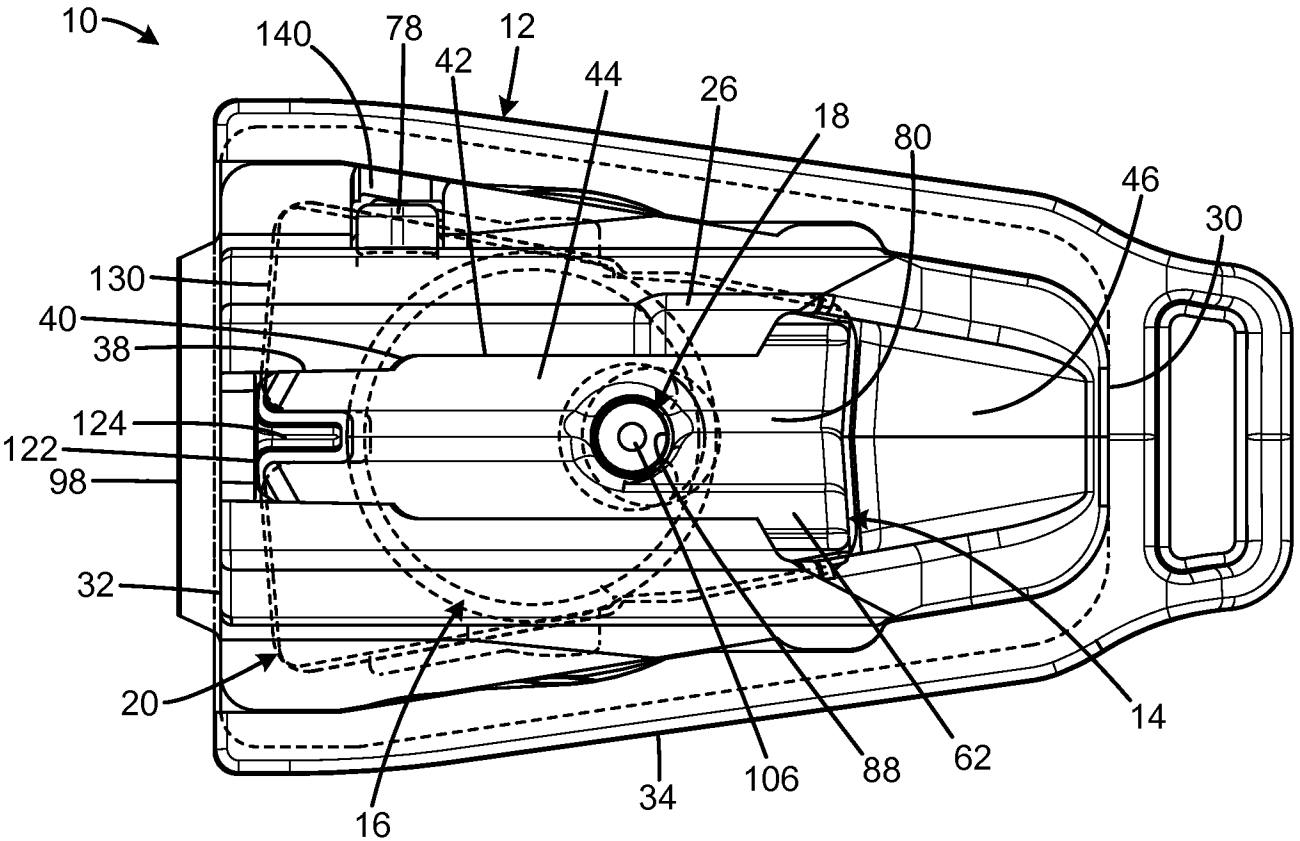
FIG. 6A is a top view of the current embodiment of the double stack magazine constructed in accordance with the principles of the present invention.
Figure 6B:
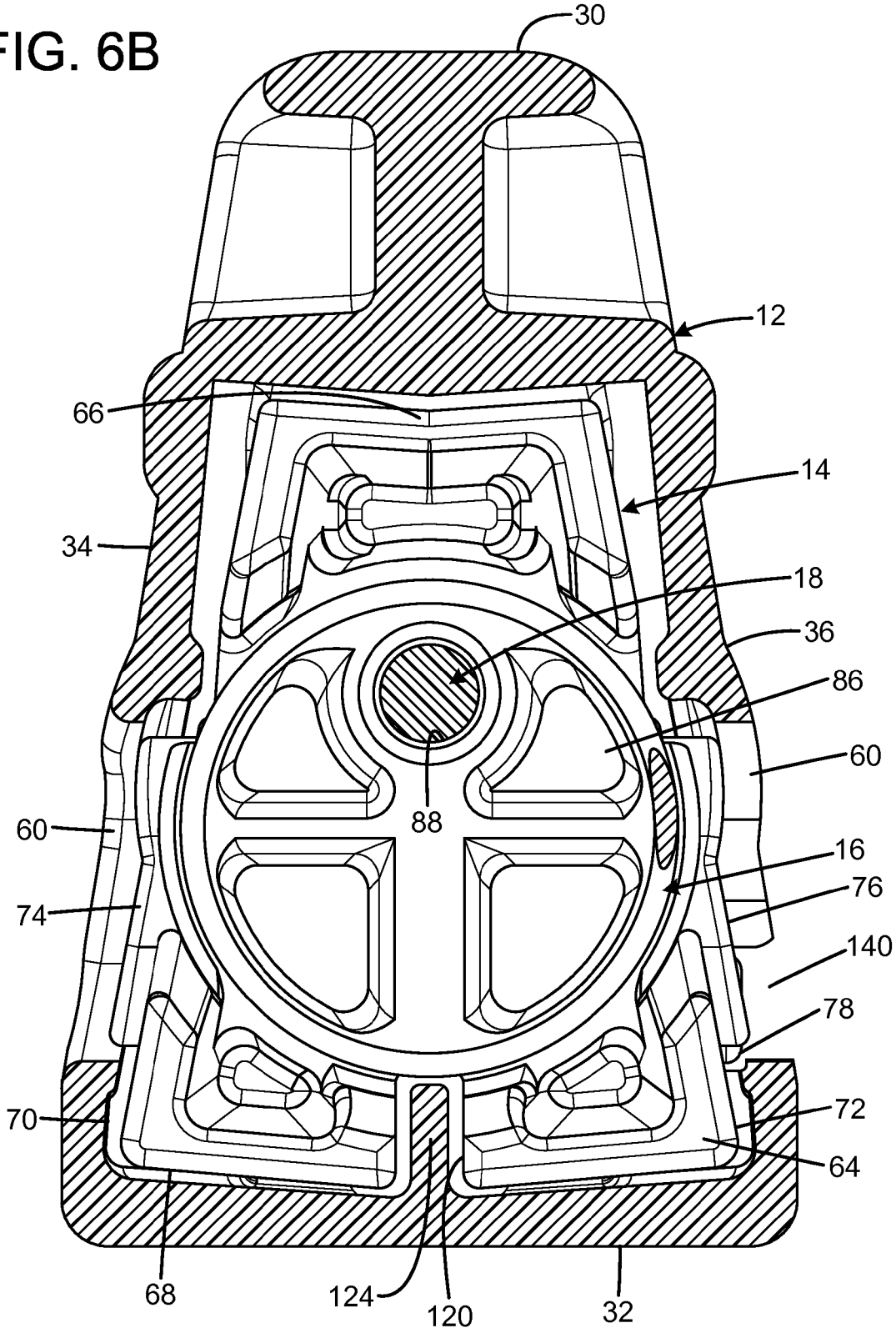
FIG. 6B is a bottom sectional view of the current embodiment of the double stack magazine constructed in accordance with the principles of the present invention.

FIGS. 6A and 6B illustrate the improved double stack magazine 10 of the present invention. More particularly, the double stack magazine 10 is shown unloaded. The spring 16 has urged the follower 14 upwards until the top 26 of the body 12 prevents further upward movement. In this position, the upward protrusion 78 extends upward through an aperture 140 in the left rear of the body 12. In this position, the upper protrusion engages the slide stop in the firearm, which locks the slide back when the magazine is empty.

The slot 122 in the rear 130 of the spring plate 20 and the slot 120 in the rear 68 of the follower 14 receive the rib 124 that protrudes forward from the rear 32 of the body 12. The outer shape of the follower and the rear slot permit the follower to slide freely up and down within the body without tilting forward or sideways. The spring is positioned in front of, and supported by, the rib and encompasses the separating rod 18. The spring is also supported by the left 36 and right 34 sides of the body.

The rear of the spring is directly supported by contact with the forward surface of the rib 124. The spring is supported laterally and against substantial forward excursion by the walls of the follower; the spring is not otherwise fully constrained against lateral or forward movement in its midsection, but this flexing is tolerated. The front portion of the spring is spaced apart forwardly from the separating rod, even when the rear of the spring is against the rear rib 124. This ensures the spring does not rub on or generate force against the separator, which could generate unwanted friction between the rod and the follower 14.

By encompassing the rod, the spring may be of a simple, economical and reliable circular or helical coil, as opposed to more complex types that would have to articulate behind any such separator, including potentially inwardly of concave articulations that are difficult to form by the normal method of winding a spring wire about a polygonal form. Also by encompassing the rod, a relatively large coil diameter may be employed, which enables substantial spring force and stability within a given magazine size.

In alternative embodiments, the spring may be polygonal in cross section or have essentially any other profile. In further alternatives, the separating rod may be connected to or reach closer to the forward wall of the magazine body, with the follower having a slot open to the front to receive it and be guided by it. In such an embodiment, the spring would be shaped to largely fill the space behind the separator.

Figure 7A:
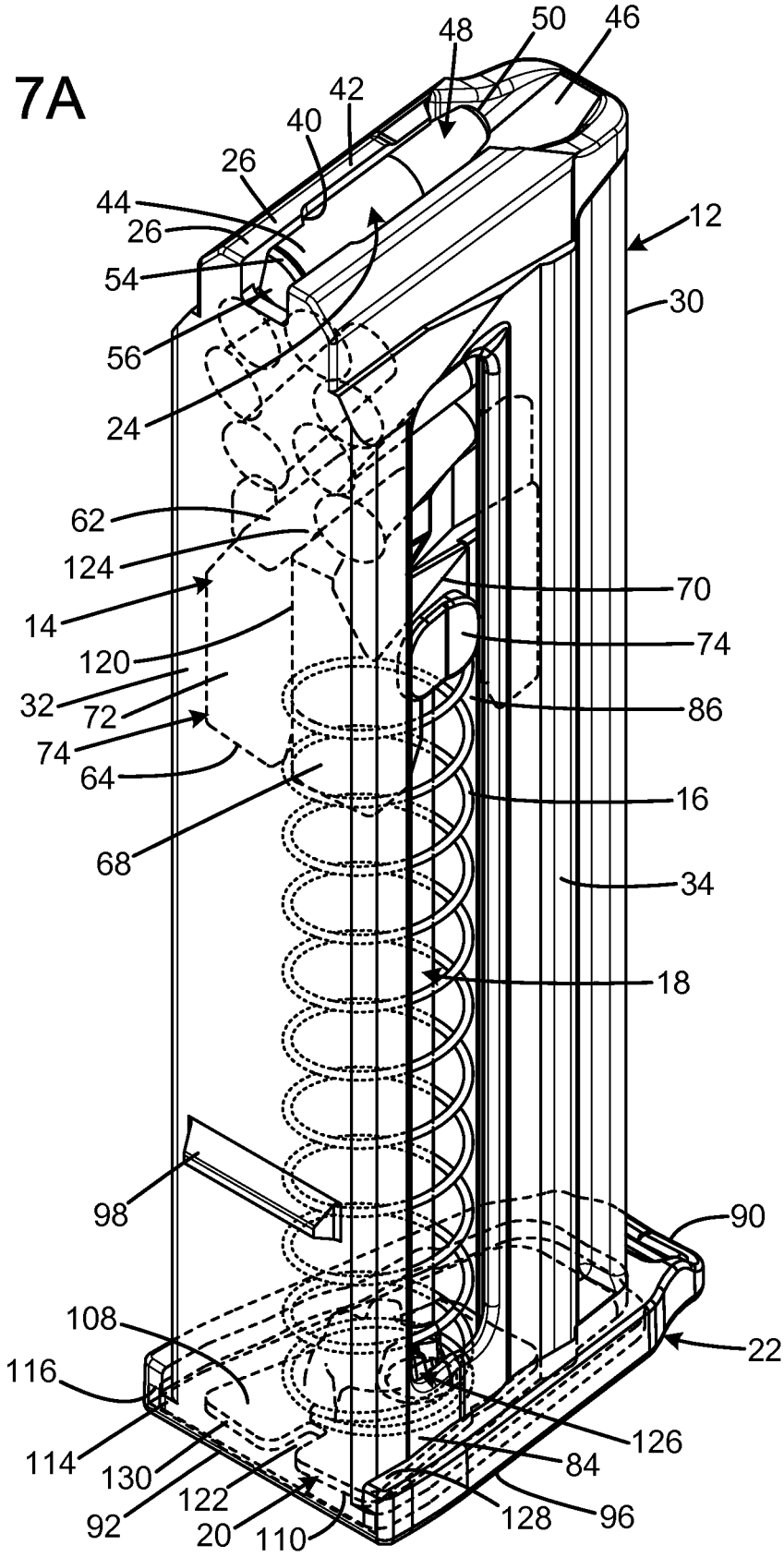
FIG. 7A is a rear isometric view of the current embodiment of the double stack magazine constructed in accordance with the principles of the present invention.
Figure 7B:
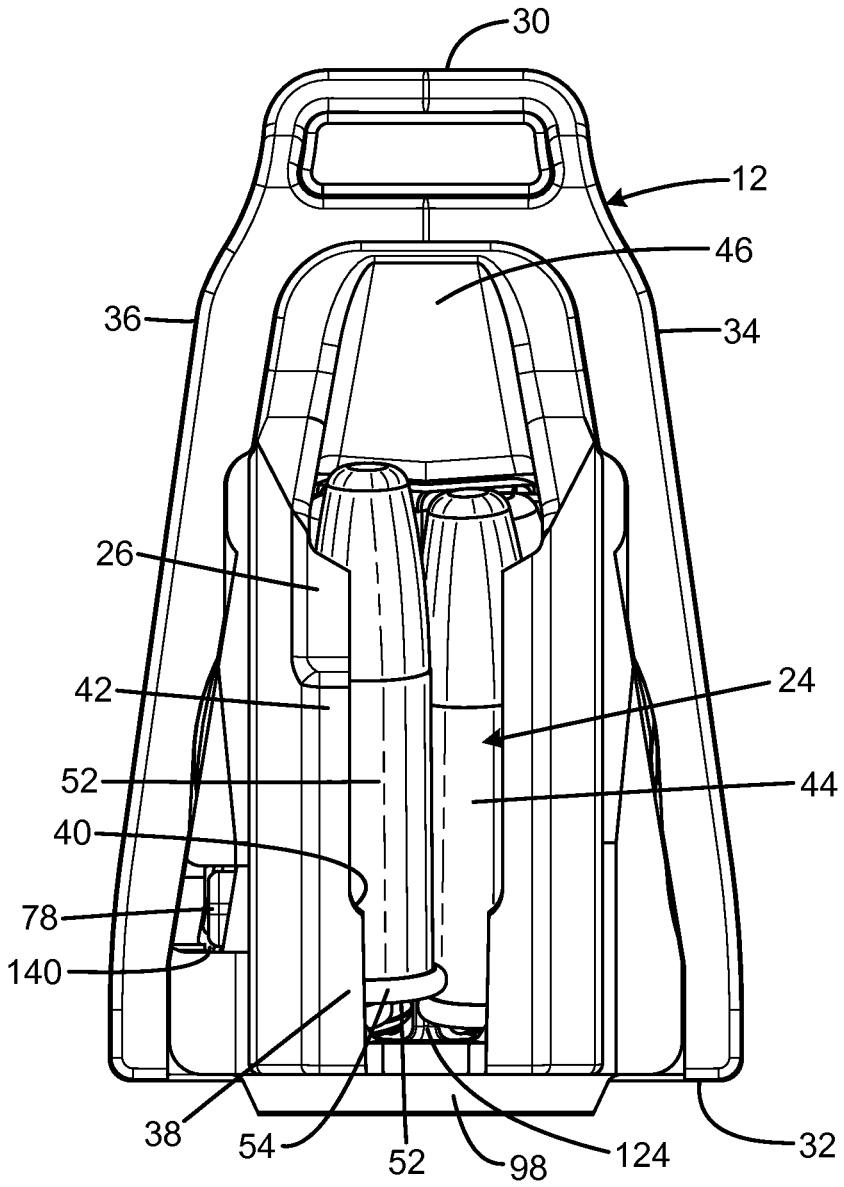
FIG. 7B is a top view of the current embodiment of the double stack magazine constructed in accordance with the principles of the present invention.
Figure 7C:
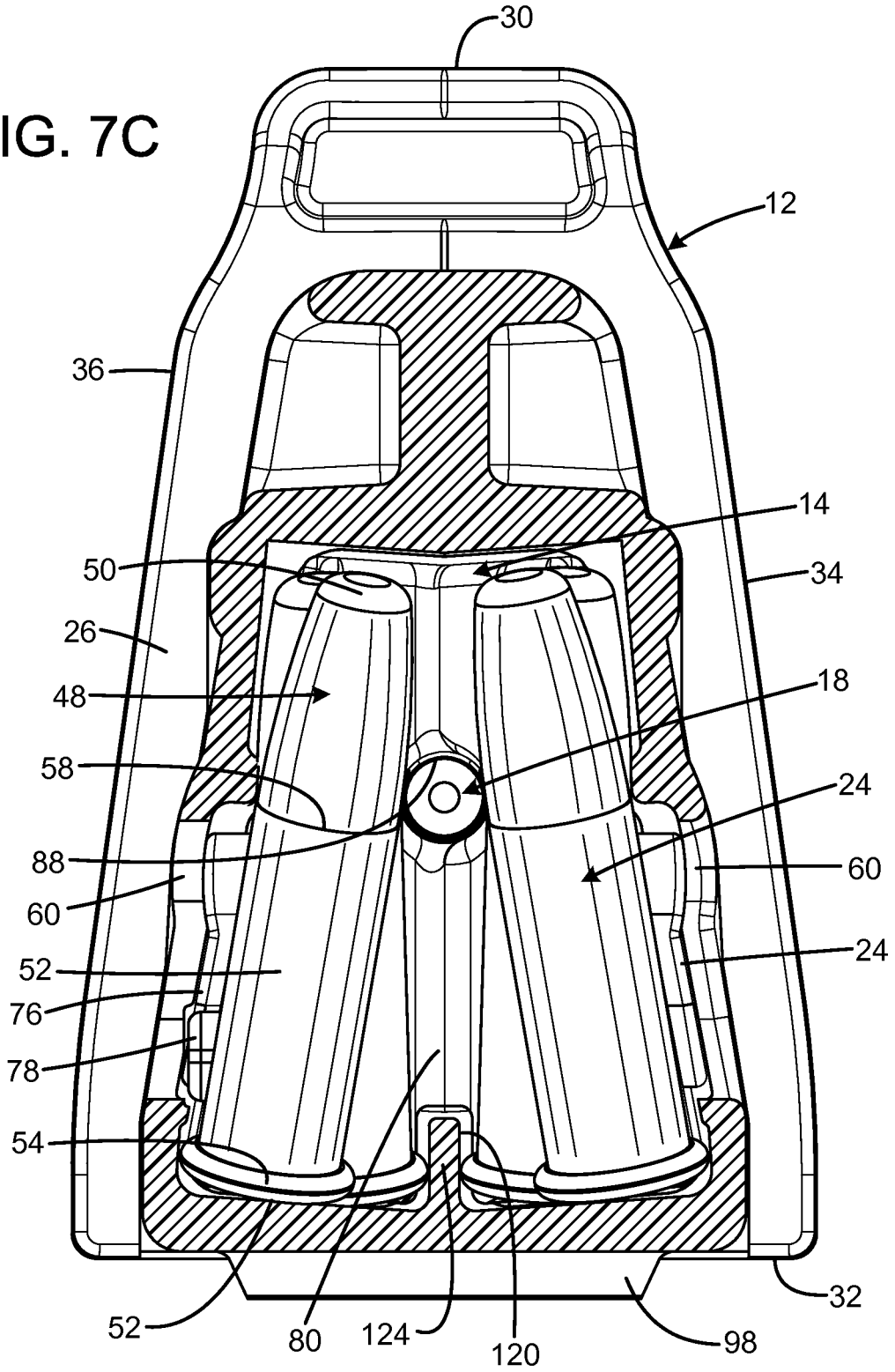
FIG. 7C is a top sectional view of the current embodiment of the double stack magazine constructed in accordance with the principles of the present invention.

FIGS. 7A-7C illustrate the improved double stack magazine 10 of the present invention. More particularly, the double stack magazine 10 is shown partially loaded. The follower 14, acted upon by the spring 16, has urged the remaining nine cartridges 24 upwards. The uppermost cartridge is positioned with its rim 54 in front of the cartridge below, even though the cartridge below resides in the other stack. The rear lips 38, radiused portion 40, and front lips 42 define an opening 44 through which the uppermost cartridge is extracted. The rear lips make the opening narrower than the rim of the cartridge to limit upward movement. As the firearm's bolt pulls the uppermost cartridge forward pass the radiused portion, the opening widens so the cartridge can rise. The ramp 46 at the top front of the body noses the cartridge upwards and centers the cartridge as it is stripped. Once the uppermost cartridge is removed, the spring urges the follower upwards until the next cartridge is retained by the rear lip 38, radius portion 40, and front lip 42 immediately above.

To load the double stack magazine 10, a first round is pushed down on top of the follower about ½ inch forward of the rear of the magazine body. While continuing to hold the round down, the round is slid rearward until the round stops. The first round will slide over to the left slightly. The next round is pushed down on top of the previous round and slid back again. This round will slide over to the right slightly. Continue by loading one round in the left stack, then loading one round in the right stack, and repeating until the magazine body is full. Gripping the pads on the follower and pulling down slightly as each round is pushed down facilitates loading.

As each round is loaded, the position of the round can be observed through elongate slots in the left and right sides of the body. The rears of the rounds in each column must stagger right/left/right/left as they are loaded. If a round is not staggered correctly, a small tool or the tip of a round must be used to reposition the rear of the round in place. It is best to continue to look at both sides of the magazine during loading to ensure rounds come to rest in the correct stagger. If the rounds are not staggered correctly, they will not feed correctly, and the firearm will likely jam.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a double stack magazine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine for a firearm comprising:

a tubular body having surfaces defining an elongated passage and having a lower end and an upper end having feed lips;

a floor plate element connected to the lower end;

an elongated separator element within the passage spaced apart from the body surfaces;

a follower defining an aperture receiving and surrounding the separator element and movable within the elongated passage;

the follower movable within the passage from a lowest position to a highest position, wherein at least a portion of the follower is within no more than one cartridge diameter from the feed lips when in the highest position;

the separator element extending from the lower end of the body to a level proximate to the upper end;

the aperture of the follower receiving an upper end portion of the separator when the follower is in the highest position; and a spring within the passage having a first end contacting the floor plate, and having an opposed second end contacting and biasing the follower toward the upper end of the body; and wherein the body has a rear wail, and wherein the rear wall includes a medial rib extending forward, such that the rib defines a separation between a stack of cartridges right of the rib, and a stack of cartridges left of the rib.

2. The magazine of claim 1 wherein the separator is a rod having a circular cross-section.

3. The magazine of claim 1 wherein the spring is spaced apart from the separator element.

4. The magazine of claim 1 . wherein the separator element is encompassed by the spring.

5. The magazine of claim 1 wherein the separator element is medially located in the body.

6. The magazine of claim 1 wherein the body has opposed major right and left side walls, and wherein the separator element is positioned medially between the side walls.

7. The magazine of claim 1 wherein the body has opposed major right and left side walls, and wherein the separator element is positioned between the side walls to define a first stack passage between the left side wall and the separator element, and a second stack passage between the right side wall and the separator element.

8. The magazine of claim 1 wherein the follower has a rear wall, and wherein the rear wall of the follower includes slot that closely receives the medial rib.

9. The magazine of claim 1 wherein the floor plate defines an aperture closely receiving the separator element.

10. The magazine of claim 1 wherein the follower positions the separator element by acting as a sliding support bushing as the follower moves within the body.

11. A magazine for a firearm comprising:

a tubular body having surfaces defining an elongated passage and having a lower end and an upper end having feed lips;

a floor plate element connected to the lower end;

an elongated separator element within the passage spaced apart from the body surfaces;

a follower defining an aperture receiving the separator element and movable within the elongated passage;

the follower movable within the passage from a lowest position to a highest position, wherein at least a portion of the follower is within no more than one cartridge diameter from the feed lips when in the highest position;

the separator element extending from the lower end of the body to a level proximate to the upper end;

the aperture of the follower receiving an upper end portion of the separator when the follower is in the highest position; and a spring within the passage having a first end contacting the floor plate, and having an opposed second end contacting and biasing the follower toward the upper end of the body; wherein the spring is a circular coil spring having multiple winds, each encompassing the separator element.

12. A magazine for a firearm comprising:

a tubular body having surfaces defining an elongated passage and having a lower end and an upper end;

a floor plate element connected to the lower end;

an elongated separator element within the passage;

the separator element having a fore to aft dimension substantially the same as a right to left dimension;

a follower defining an aperture receiving the separator element and movable within the elongated passage;

a spring within the passage having a first end contacting the floor plate, and having an opposed second end contacting and biasing the follower toward the upper end of the body;

the elongated separator element being within the portion of the elongated passage encompassed by the spring; and wherein the body has a rear wall, and wherein the rear wall includes a medial rib extending forward, such that the rib defines a separation between a stack of cartridges right of the rib, and a stack of cartridges left of the rib.

13. The magazine of claim 12 wherein the follower defines a slot closely receiving the rib.

14. The magazine of claim 12 wherein the separator is a rod spaced apart from the body surfaces.

15. The magazine of claim 12 wherein the spring is spaced apart from the separator element.

16. The magazine of claim 12 wherein the spring is a circular coil spring having multiple winds, each encompassing the separator element.

17. The magazine of claim 12 wherein the separator element is medially located in the body.

18. The magazine of claim 12 wherein the body has opposed major right and left side walls, and wherein the separator element is positioned medially between the side walls.

19. The magazine of claim 12 wherein the body has opposed major right and left side walls, and wherein the separator element is positioned between the side walls to define a first stack passage between the left sidewall and the separator element, and a second stack passage between the right sidewall and the separator element.

* * * * *